US005255624A

United States Patent [19]

Legare

[11] Patent Number: 5,255,624

[45] Date of Patent: Oct. 26, 1993

[54] SAILBOAT MAST FLOATATION DEVICE

[76] Inventor: David J. Legare, 11 Bonnie Ave., New Hartford, N.Y. 13413

[21] Appl. No.: 890,721

[22] Filed: Jun. 1, 1992

[51] Int. Cl.[5] ..... B63H 9/04

[52] U.S. Cl. ..... 114/68; 114/61; 114/90

[58] Field of Search ..... 114/39.1, 90, 102, 111, 114/68, 103; 441/90-101

[56] References Cited

U.S. PATENT DOCUMENTS

| | | | |
|---|---|---|---|
| 797,136 | 8/1905 | Manlove | 441/98 |
| 1,412,803 | 4/1922 | Frantz | 441/99 |
| 3,016,858 | 1/1962 | Johnson | 114/39.1 |
| 3,016,859 | 1/1962 | Johnson | 114/39.1 |
| 3,016,860 | 1/1962 | Johnson | 114/39.1 |
| 3,889,045 | 6/1975 | Logsdon | 114/90 |
| 4,461,230 | 7/1984 | Hartley et al. | 114/90 |
| 4,651,666 | 3/1987 | Lake | 114/39.1 |
| 4,850,912 | 7/1989 | Koyanagi | 441/80 |

FOREIGN PATENT DOCUMENTS

| | | | |
|---|---|---|---|
| 2515135 | 4/1983 | France | 114/123 |

*Primary Examiner*—Edwin L. Swinehart
*Attorney, Agent, or Firm*—Charles S. McGuire

[57] ABSTRACT

An inflatable mechanism for attachment to the top of a sailboat mast to counteract turtling (complete rotation of the boat into an inverted position where the mast is pointed straight down into the water) during a capsize. The device functions by producing a torque consisting of the water displacement force and the mast as a lever arm. When the boat tips over on its side during a capsize this torque balances the boat's natural tendency to continue to roll over into an inverted position.

9 Claims, 1 Drawing Sheet

SAILBOAT MAST FLOATATION DEVICE

BACKGROUND

Capsizing is a common and frequent problem for small sailboats on the order of 21 feet or less in length. Unlike larger sailboats, most of these do not have a weighted keel to prevent the boat from turtling when the boat is pushed over onto its side. Capsizing is particularly troublesome for catamarans. These boats have proportionately much greater widths and longer masts than monohulled boats of comparable length. These physical characteristics make catamarans very difficult to right, especially from the turtled position.

A number of devices have been developed to assist the sailor with capsize recovery. These generally can be broken down into two categories; those which add weight or increase leverage to the hull side of the boat, and those which add floatation to the top end of the mast. The first of these can be used both to help rotate the boat from the turtled position to the point where the mast is parallel to the surface of the water (boat on its side) and also to complete the righting process by helping to continue to rotate the boat so that the mast pulls out of the water and the boat becomes upright. Examples of such devices are water bags and extension lines attached to the hull(s) for the purpose of effectively increasing the sailor's weight and leverage. The second type of device operates strictly to prevent or counteract the rotation of the boat into an inverted position after it has fallen on its side. The floatation at the mast tip tends to lift the mast to the surface, thus keeping the boat on its side. This function could be implemented as a solid attachment such as a polystyrene or hollow rigid ball mounted atop the mast, or as an inflatable balloon which is activated during a capsize and later deflated.

It is a principal object of the present invention to use the latter approach to provide an "anti-turtling" capability for small sailboats.

A further object is to provide an inflatable balloon device which is light-weight, low-profile, and unobtrusive so that it can be used without marring the aesthetics or hindering the normal operation of the sailboat.

Another object of the invention is to provide a righting device which can be easily attached to and removed from virtually any type of small sailboat without requirement for boat modifications or installation tools.

Another object is to provide an inflatable balloon righting device which can be activated and deactivated (balloon inflated and deflated) from the base of the mast.

Still another object is to provide for a sailboat righting system which uses relatively low cost, readily-available, and environmentally safe materials in its manufacture and for its operation.

Other objects will in part be obvious and will in part appear hereinafter.

SUMMARY OF THE INVENTION

In accordance with the foregoing objects, the invention contemplates a sailboat righting device consisting of an inflatable balloon surrounded by netting or mesh material, a small compressed gas source such as a standard 12 gram CO2 (carbon dioxide) cartridge enclosed in a holder which includes a mechanism to puncture the cartridge to release the compressed gas into a flexible plastic tube which is connected to the balloon. The upper end of the net (balloon enclosure) is attached to the top of the mast via a short (approx. 12 to 18 inches) section of elastic cord (about $\frac{1}{4}$ to $\frac{3}{8}$ inch diameter). The lower end is tied to a narrow hold-down cord (approx. $\frac{1}{8}$ diameter nylon rope) which extends down along the length of the mast to the boat deck (trampoline in the case of a catamaran) where it can be tied down to a cleat or other convenient anchor point. The balloon (located inside the net enclosure) is connected to an appropriate fitting on the end of the plastic delivery tube which also extends beyond the length of the mast and attaches to a fitting on the compressed gas cartridge holder. The cartridge holder is then stowed in a place on the deck where it can be conveniently reached during a capsize. Small guide rings are also included every three to four feet or so along the length of the tube. The hold-down cord is strung through these so that the two remain together along the mast. The unit can be installed by first attaching the free end of the elastic cord on the net to the shackle at the end of the main halyard line and then hoisting it to the top of the mast along with the sail. The narrow cord connected to the other end of the net is then tied down to a point near the base of the mast. The cord is first pulled taught to stretch the elastic cord somewhat before tying down. This helps to keep the plastic tube flat against the mast and also helps the balloon to deflate faster and more completely due to the tension produced on the sides of the net. The device could be activated by either manual or automatic means. In the manual case, the user would be required to engage the puncture mechanism provided on the cartridge holder to release the compressed gas. Any of a number of possible mechanisms could be utilized, including a trigger device which controls a spring-loaded punture pin, or a configuration in which the user provides the puncture force by simply twisting a screw at the end of the cartridge holder, thus pushing the tip of the cartridge against the puncture pin. Several well-known automatic mechanisms could also be employed. Generally with these, a spring-loaded trigger mechanism would be used in combination with a sensor which activates the trigger when the boat tips over. As such, the sensor could consist of a number of known simple devices such as a pendulum which pulls the trigger as the boat tips over to a certain angle. The balloon is deflated by simply opening the cartridge holder or by implementing a valve on the cartridge holder or delivery tube which can be opened and closed by the user.

The foregoing and other features of the invention will be more readily understood and appreciated from the following detailed description, taken in conjunction with the accompanying drawings.

DETAILED DESCRIPTION

Figure 1:
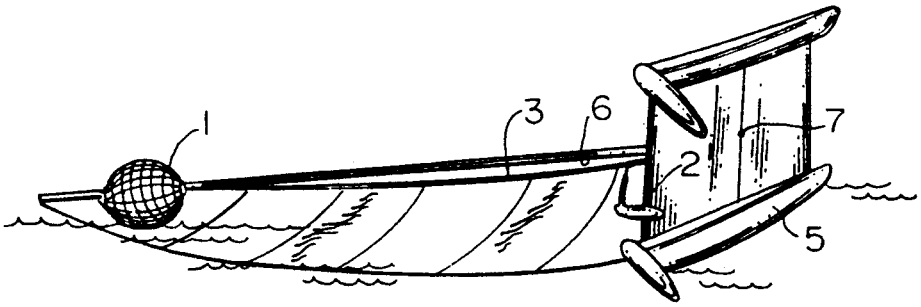
FIG. 1 is a perspective view which shows the functional relationship of the invention to the sailboat (tipped over on its side in the water) on which it is attached.

Referring now to the drawings, in FIG. 1 is seen the inflated balloon 1. Inflation of the balloon is provided by the puncturing of a compressed gas cartridge (typically a standard 12 g CO2 cartridge) contained inside the cartridge holder 2. The cartridge holder is connected to the balloon via a flexible plastic delivery tube 3. The tube preferably consists of a very flexible, strong, inexpensive material such as clear vinyl. The tube should be as small in diameter as possible to maintain a low profile against the mast, but must also have a sufficiently large inner cross section to allow enough gas flow to provide rapid inflation and deflation of the balloon and have a wall thickness which can withstand the high pressure experienced near the cartridge holder during inflation. As such, a clear vinyl tube which has an inner diameter of around 3/16 inches and an outer diameter of around 5/16 inches appears to be optimum. FIG. 1 also clearly illustrates the function of the invention as a boat righting device. It is seen that the balloon 1 produces an upward floatation force. Since the balloon is attached to the top of the mast, it therefore produces a torque around the center of the hull 5 (the downward hull of the catamaran for this example) which counteracts the opposing combined torque resulting from the gravitational force acting at the boat center of mass located approximately at the point on the boat indicated by the numeral 6 and the wind loading centered approximately at the point on the underside of the boat deck (trampoline in the case of the catamaran for this example) indicated by the numeral 7. Thus it can be readily seen that the sailboat mast floatation device described by the invention tends to prevent the boat from turtling.

Figure 2:
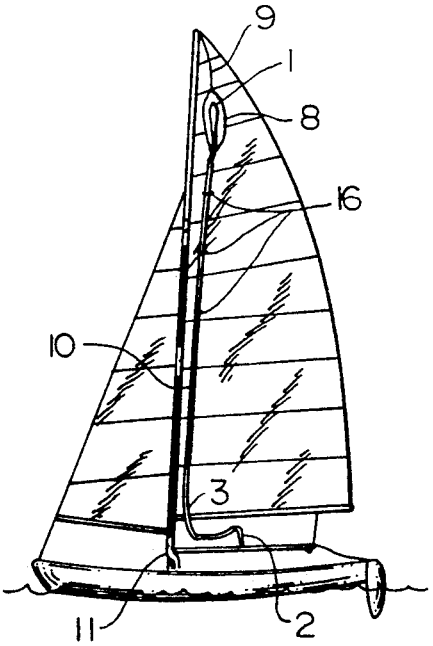
FIG. 2 is a perspective view which shows the various parts of the invention in greater detail and how the invention attaches to the sailboat.

In FIG. 2 the invention is shown in greater detail in relation to its attachment to the sailboat. Here, the balloon 1 is seen inside the net enclosure 8. The top end of the net enclosure is seen connected to the elastic cord 9 which then connects to the top of the mast. The delivery tube 3 and hold-down line 10 can be seen to run along the length of the mast. The end of the hold-down line is tied off at a point indicated by the numeral 11 at the base of the mast. The delivery tube is connected to the cartridge holder 2 which is stowed in a convenient location on the deck of the boat. The hold-down line or halyard 10 and delivery tube 3 are connected to extend substantially adjacent to one another by connecting rings 16 (FIG. 2).

Figure 3:
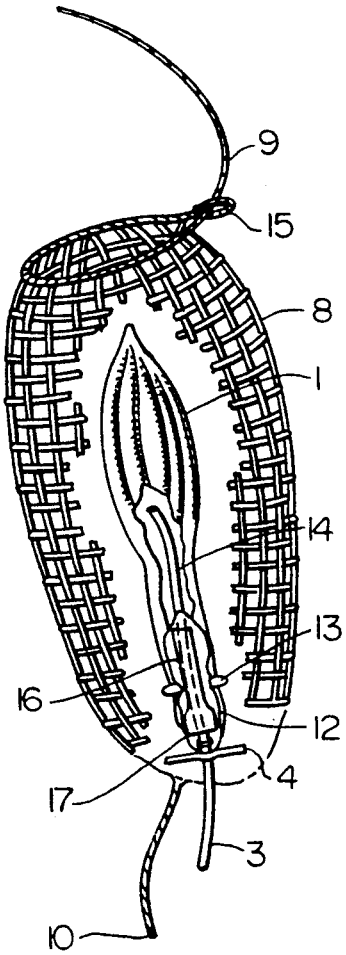
FIG. 3 is an enlarged perspective view of the balloon and net enclosure with portions broken away to show the details of this section of the device.

In FIG. 3 the upper end (balloon and net enclosure) of the device is shown in greater detail. Here it can be seen that the neck of the balloon 1 slides over a fitting 12 which is connected to the delivery tube 3. The fitting could consist of a simple reducing connector (or two reducing connectors in series) but is preferably molded (via thermoplastic injection molding) over the end of the delivery tube. Although the tube would typically be crushed during this type of molding process, high pressure molding of a fitting over the tube is made possible by the prior addition of a rigid plastic sleeve 16 (i.e. polypropylene with an ID of 5/16" and an 1/16" wall thickness) over the portion of the tube over which the fitting is to be molded (note that a sleeve of narrower diameter could likewise be fitted to the inside of the tube to provide the same basic function).

A thin piece of stiff wire 17 (about 1" long) is preferably first inserted radially through both pieces of tubing and bent over on each end to prevent slippage of the fitting. The balloon is further secured to the fitting by one or more clamps 13, preferably some type of plastic hose clamp which can easily tightened and loosened by hand. It furthermore can be seen that a short length of tubing 14 (approx. 4 to 6 inches long) extends from the wide end of the fitting 12 into the balloon 1. This has a very important function in that it assures that the balloon inflates properly even if the balloon is twisted or bent over itself when the device is activated. Without this tube, the balloon could be forced or torn off the fitting due to an inability of the gas to flow into the balloon as a result of the balloon being twisted or bent over at or near its neck. The tube section 14 is provided as either a separate piece of tubing which is attached inside the open end of the fitting 12 or by simply attaching or molding the fitting so that a portion of the delivery tube 3 extends the proper distance beyond the open end of the fitting. It is furthermore seen that the upper end of the net enclosure 8 is open and that it has the lower end of the elastic cord 9 threaded around its edge (and looped through itself via a metal ring 15 at one end) so that it can be opened to remove the balloon and fitting assembly (for periodic replacement of the balloon) and then pulled shut when tension is placed on the upper end of the elastic cord 9. It is furthermore seen that the upper end of the hold-down line 10 is tied to the lower end of the net enclosure 8 (the lower end of the net is always closed). The delivery tube 3 simply protrudes through one of the holes in the lower end of the net enclosure 8. A flange 4 which is either integral to the fitting 12 or a separate piece assures that the fitting 12 and balloon 8 assembly do not get accidentally pulled through the net enclosure 8. Thus, it can be seen that the invention provides a simple, reliable, and readily manufacturable device which can be readily applied to prevent turtling of a sailboat during a capsize.

What is claimed is:

1. A device for producing a buoyant force to a sailboat mast having upper and lower ends, said device comprising:

a) an inflatable balloon having an open end;

b) means connecting said balloon to said mast adjacent said mast upper end;

c) a source of compressed gas selectively actuable to emit said gas through an outlet, said gas source positioned adjacent said lower end of said mast;

d) an enclosed tube having opposite open ends respectively connecting said gas source outlet and said balloon for inflation of said balloon in response to actuation of said gas source;

e) a halyard extending substantially along said mast;

f) means connecting one end of said halyard to said balloon; and g) a plurality of guide rings connecting said enclosed tube and said halyard to maintain said tube and halyard substantially adjacent one another.

2. The invention as described in claim 1 wherein said connecting means comprises netting surrounding said balloon, and a cord having first and second opposite ends securing said netting to said mast.

3. The invention as described in claim 1 further comprising a tubular fitting having first and second opposite ends wherein said first end is positioned within said balloon's open end and said second end is positioned outside said balloon adjacent said balloon's open end, and one of said ends of said enclosed tube engages said second end of said fitting allowing said actuated gas source to inflate said balloon.

4. The invention as described in claim 1 wherein said enclosed tube is flexible.

5. The invention as described in claim 2 wherein said cord is elastic.

6. The invention as described in claim 3 further comprising a clamp, said clamp being positioned around said balloon's open end clamping said fitting in said balloon's open end.

7. A system for producing a buoyant force to a sailboat mast having upper and lower ends, said system comprising:

a) an inflatable balloon having an open end;

b) means connecting said balloon to said mast adjacent said mast upper end, said connecting means comprising netting having upper and lower ends surrounding said balloon, and a cord having first and second, opposite ends;

c) said cord being threaded through said netting adjacent said netting upper end and passed through a loop at said cord second end, said cord first end being secured to said mast upper end;

d) a halyard secured at one end to said netting lower end, and at the other end to said mast;

e) a source of compressed gas selectively actuable to emit said gas through an outlet, said gas source positioned adjacent said lower end of said mast; and f) an enclosed tube having opposite open ends respectively connecting said gas source outlet and said balloon for inflation of said balloon in response to actuation of said gas source.

8. The invention as described in claim 7 wherein said halyard is secured at said other end thereof adjacent said mast lower end.

9. The invention as described in claim 7 and further including a plurality of guide rings for maintaining said halyard and said tube substantially adjacent one another.

* * * * *